United States Patent [19]

Brubaker

[11] 4,007,917

[45] Feb. 15, 1977

[54] STRUCTURES FOR ABSORBING IMPACT ENERGY

[75] Inventor: Burton D. Brubaker, Midland, Mich.

[73] Assignee: The Dow Chemical Company, Midland, Mich.

[22] Filed: Sept. 4, 1975

[21] Appl. No.: 610,482

Related U.S. Application Data

[63] Continuation-in-part of Ser. No. 449,146, March 7, 1974, abandoned.

[52] U.S. Cl. ..... 256/13.1; 428/312; 404/6

[51] Int. Cl.[2] ..... A01K 3/00; E01F 15/00

[58] Field of Search ..... 256/13.1; 404/6; 428/312

[56] References Cited

UNITED STATES PATENTS

| | | | |
|---|---|---|---|
| 2,999,043 | 9/1961 | Glynn | 428/95 |
| 3,300,289 | 1/1967 | Long | 65/22 |
| 3,673,290 | 6/1972 | Brubaker et al. | 428/312 |
| 3,709,772 | 1/1973 | Rice | 428/312 |

*Primary Examiner*—William J. Van Balen
*Attorney, Agent, or Firm*—V. Dean Clausen

[57] ABSTRACT

Disclosed is a concept for covering rigid members with a layer of an energy absorbing material, such as a ceramic foam or glass foam. In a specific application of the invention, the foam layer is used to cover highway structures, such as bridge columns. The objective is to make the highway structure capable of absorbing impact energy from a moving vehicle in the event of a collision.

3 Claims, No Drawings

STRUCTURES FOR ABSORBING IMPACT ENERGY

CROSS-REFERENCE TO RELATED APPLICATION

This application is a continuation-in-part of U.S. Ser. No. 449,146, filed Mar. 7, 1974, and copending herewith, now abandoned.

BACKGROUND OF THE INVENTION

The invention relates broadly to structures which will absorb the impact energy of a moving object. More particularly, the invention is directed to use of ceramic foams or glass foams, as energy absorbing materials, to cover rigid members, such as highway structures.

It is common practice to use plastic resin foams, such as the closed-cell polyurethanes, polystyrenes, and polyethylenes, as cushioning materials. For example, these plastic foams are frequently used as energy absorbers to prevent damage to objects during shipping. Another use of this material is as crash padding in automobiles to prevent harm to the occupants of the vehicle during a collision. The plastic foams, however, are not entirely satisfactory as energy absorbing materials.

A particular problem is that when an object impacts with a plastic foam, there is a distinct recoil or rebound of the object. The recoil is caused by trapped gas in the cell structure of the foam. In other words, if the cell walls do not fracture upon impact of the object with the plastic foam, the trapped gas will compress. When the impact pressure is released, therefore, the gas expands the cell walls and pushes back on the impacting object.

SUMMARY OF THE INVENTION

The invention provides a structure for absorbing the impact energy of a moving object. The basic structure includes a rigid member, such as a highway bridge column, and a layer of an energy absorbing foam material which covers the member and is fastened to the member. Preferred foam materials are rigid, inorganic, multicellular foams, such as ceramic foams or glass foams. The density of the foam materials is from about 6–20 pounds per cubic foot and the flexural strength is from about 50–250 pounds per square inch.

DESCRIPTION OF A PREFERRED EMBODIMENT

In one embodiment of this invention it is contemplated to cover rigid members, such as bridge columns, highway guard rails, highway divider strips, and the like, with the ceramic and glass foam materials described herein. The objective is to provide such structures with a material which will absorb energy from collision of a vehicle with the structure. In another embodiment it is contemplated that the foams of the invention could be used as energy absorbing cushioning material for the front and rear bumpers of highway vehicles, such as automobiles.

Typical ceramic foam materials which may be used as the energy absorbing layer are those compositions described in U.S. Pat. No. 3,673,290, to Brubaker and Waldman, and U.S. Pat. No. 3,056,184, to Blaha. The teachings of these patents, particularly with regard to preparation of the ceramic foam and the description of the resulting product, are incorporated herein by reference. Following is a brief description of certain properties of the preferred ceramic foams, some of which are disclosed in the aforementioned patents:

| | |
|---|---|
| Construction | Multicellular (closed cells) |
| Slab density | 6–20 lbs. per cu. ft. |
| Flexure strength | 65–250 lbs. per sq. in. |

Suitable glass foams which may be used as the energy absorbing layer are commercially available compositions sold under the name FOAMGLAS. The general preparation of these glass foams is described by N. G. Farquhar, "Glass Cellulation Produces Light Weight Insulation", Chemical and Metallurgical Engineering (August, 1943), pp. 98–101. The description in the Farquhar reference, as regards preparation of these glass foams, is incorporated herein by reference.

Various physical properties of the glass foams described in the Farquhar reference are given in another reference. The second reference is a sales brochure entitled "Industrial Insulation from Pittsburgh Corning for Operating Temperatures from −450° F. to 1200° F.", Pittsburgh Corning Corp., page 2.

Following is a brief description of some of the properties of the glass foams which are described in the aforementioned reference.

| | |
|---|---|
| Construction | Multicellular (closed cells) |
| Density | 9 lbs. per cu. ft. |
| Flexure strength | 75 lbs. per sq. in. |

For the practice of this invention, the glass foams should have a density somewhere between about 6 to 20 pounds per cubic foot.

In certain applications of the present concept the ceramic or glass foam cushioning layer will be covered with an overlying protective layer of a film material. One example of this embodiment would be where the cushioning layer is used to cover an outdoor structure, such as a bridge column. The purpose of the protective layer is to prevent wearing away of the cushioning layer, as by dusting, or abrasion, which can be caused by exposure to weather or other factors.

Suitable materials which may be used as the protective layer are several of the known thermoplastic and thermosetting resin films. Typical examples are polyethylene films, polyvinyl fluoride films, polyvinylidene chloride films and polyvinyl chloride films. Many of these films are commercially available under the trade names MYLAR, TEDLAR, and Saran. The films may be adhered to the foam cushioning layer by any of the known techniques which will achieve a satisfactory bonding of the film to the foam material. An example of such a technique is heat shrinking of the film to the foam layer.

The foam cushion layer may be attached to the rigid member by any of various known fastening means. For example, if the rigid member is a bridge column, the foam layer can be bonded to the concrete structure with an adhesive composition, such as an epoxy resin adhesive. The practice of this invention also contemplates incorporating a reinforcing material into the foam cushion layer in certain constructions. An example of such a construction is where the foam cushion is a free-standing piece, that is, it is not attached to a rigid member. For this type of structure it would be desirable to reinforce the foam layer with a high strength material, because of the low tensile and flexural strength of the inorganic foam. Suitable reinforcing materials which may be used are metal plates, metal rods, or heavy plastic resin sheets, which are reinforced with glass fibers.

According to the invention, tests were conducted to determine the actual energy absorption properties of the ceramic foam and the glass foam cushioning materials. The tests described in the following examples are given to illustrate one method which may be used to calculate these energy absorption values. These examples are not intended, however, to limit the invention to the procedures described herein.

EXAMPLE I

This example describes a test for obtaining energy absorption values for a ceramic foam material employed in the practice of the present invention, and for certain plastic foam materials which are frequently used as energy absorbing materials. The purpose of the test is to provide a good comparison between these foam materials with regard to capacity for absorbing energy.

The test employed is a modification of a standard method for determining shock absorbing properties of playing surfaces, specifically ASTM Test F355–72. The procedure was generally as follows. For each test the foam piece used was a slab which measured about 4 inches square by 2 inches thick. At the start of the test the foam slab was supported on a flat metal plate, with a flat metal missile resting against the upper surface of the slab. The missile was then raised a predetermined distance above the slab and allowed to free fall onto the slab. The impact force on the slab was measured by a transducer which was associated with the missile and which monitored the deceleration-time history of the impact. An oscilloscope connected into the transducer provided a device for recording the actual impact force. The test results are set out in Table I.

TABLE I

Energy Absorption Capacity of Ceramic Foams and Plastic Foams

| Test No. | Foam Material | Average Foam Density (in lbs per cu. ft) | Missile Weight (in lbs) | Static Stress (in psi) | Missile Impact Energy (in ft lbs) | Missile Rebound Energy (in ft lbs) |
|---|---|---|---|---|---|---|
| 1 | Ceramic | 9.23 | 16 | 1.0 | 25.8 | 0.20 |
| 2 | " | " | 32 | 2.0 | 56.4 | 0.10 |
| 3 | " | " | 48 | 3.0 | 83.7 | 0.00 |
| 4 | Polyurethane[a] | 2.07 | 16 | 1.0 | 25.8 | 0.90 |
| 5 | " | " | 32 | 2.0 | 56.5 | 1.40 |
| 6 | Polystyrene[b] | 1.93 | 16 | 1.0 | 25.8 | 0.90 |
| 7 | " | " | 32 | 2.0 | 56.5 | 1.00 |
| 8 | Polystyrene[c] | 1.63 | 16 | 1.0 | 25.8 | 3.60 |
| 9 | " | " | 32 | 2.0 | 56.5 | 5.70 |
| 10 | " | " | 48 | 3.0 | 83.7 | 8.50 |

[a]THURANE Brand plastic foam (rigid, multicellular, closed cells)
[b]STYROFOAM DB Brand plastic foam (rigid, multicellular, closed cells)
[c]STYROFOAM IB Brand plastic foam (rigid, multicellular, closed cells)

Referring to the data in Table I, the static stress figure is a value which indicates the amount of load applied to the foam slab by the metal missile when the missile is at rest position on the slab. The calculation is made by dividing the weight of the missile (in pounds) into the surface area of the foam slab (in square inches), to give a unit of stress which is expressed in pounds per square inch (p.s.i.).

The figures which are designated as impact energy in Table I are values which indicate the amount of energy applied to the foam slab by the impacting missile. These figures are obtained using the following equation:

$$E = \frac{1}{2} m v_i^2$$

where:

$E$ = impact energy of the missile (in foot-pounds)
$m$ = mass of the missile (in pounds)
$v_i$ = impact velocity of the missile (in feet per second)

In Table I the figures given in the column designated rebound energy are values which indicate energy expended by the missile when it bounces upwardly (rebounds) from the foam slab after initial impact. The rebound energy, therefore, is a direct indication of the capacity of the foam slab to absorb and store the force (energy) initiated by the impacting object, and to release the force back to the impacting object. These values are calculated from a modified form of the equation set out above. The actual equation applied is:

$$E = \frac{1}{2} m v_r^2$$

where:

$E$ = rebound energy of the missile (in foot pounds)
$m$ = mass of the missile (in pounds)
$v_r$ = rebound velocity of the missile (in feet per second)

From the data in Table I, it will be seen that the rebound energy of the missile upon impact with the polyurethane and polystyrene foams (Tests 4–10, inclusive) is considerably higher than the rebound energy developed when the missile Impacts with the ceramic foam (Tests 1–3, inclusive). The conclusion, therefore, is that the ceramic foam materials of this invention have a much greater capacity for absorbing energy without rebound than the conventional rigid plastic foams.

EXAMPLE II

This example refers to a test for determining the energy absorption capacity of the glass foam material utilized in the present invention. The test piece was a foam slab which measured about 4 inches square by 1 inch thick. At the start of the test the foam slab was supported on a flat metal surface. An impact missile, in the form of a solid steel ball, diameter 1.75 inches, and weight 0.78 pounds, was then dropped onto the slab from a height of 36 inches.

The falling missile made a concave dent in the slab, with no significant rebound being observed. An energy absorption value for the glass foam was then obtained by measuring the amount of impact energy generated by the falling missile, the depth of penetration of the missile into the foam, and the average volume of foam crushed by the falling missile. The following equation was used to derive the energy factor:

$$E=mh$$

where:

$E$ = impact energy of the missile (in foot pounds)

$m$ = mass of the missile (in pounds)

$h$ = height of the missile drop (in inches)

A second equation was used to determine average volume of crushed foam. The appropriate equation is:

$$V=(\pi/3)H_i^2(3R-H_i)$$

where:

$V$ = volume of foam crushed (in cubic inches)

$H_i$ = depth of missile penetration (in inches)

$R$ = radius of the missile (in inches)

The test results are set out in Table II.

TABLE II

| Energy Absorption Capacity of Glass Foam | | | | | |
|---|---|---|---|---|---|
| Test No. | Foam Material | Average Foam Density (in lbs per cu ft) | Missile Impact Energy (in ft-lbs) | Missile Penetration Depth (in inches) | Average Volume of Foam Crushed (in cubic inches) |
| 1 | Glass foam | 9.08 | 2.34 | 0.311 | 0.229 |

What is claimed is:

1. A highway guardrail structure which is capable of absorbing the impact energy of a moving vehicle, the structure including:

a layer of a foam material which covers the guardrail structure and which is fastened to the structure;

the foam layer being defined by a rigid, inorganic, multicellular foam selected from the group consisting of ceramic foams or glass foams which have a density of from about 6 to 20 pounds per cubic foot and which have a flexural strength of from about 50 to 250 pounds per square inch.

2. The structure of claim 1 in which the foam layer is a ceramic foam which has a density of from about 8 to 15 pounds per cubic foot.

3. The structure of claim 1 in which the foam layer is covered with a film material selected from the group consisting of thermoplastic resin films and thermosetting resin films.

* * * * *